US006056272A

United States Patent [19]

Sayler

[11] Patent Number: 6,056,272

[45] Date of Patent: May 2, 2000

[54] COMBINED LIFT AND STAND FOR VEHICLES

[76] Inventor: John G. Sayler, 2421 Ardsheal Dr., La Habra, Calif. 90631

[21] Appl. No.: 09/021,063

[22] Filed: Feb. 9, 1998

Related U.S. Application Data

[63] Continuation-in-part of application No. 08/606,289, Feb. 23, 1996, abandoned.

[51] Int. Cl.[7] ..... B66F 3/00

[52] U.S. Cl. ..... 254/131

[58] Field of Search ..... 254/113, 114, 254/119, 120, 129, 131, 133 R, DIG. 3, DIG. 4

[56] References Cited

U.S. PATENT DOCUMENTS

| | | | |
|---|---|---|---|
| 322,019 | 7/1885 | Spencer | 254/131 |
| 857,077 | 6/1907 | Labreck | 254/131 |
| 1,241,418 | 9/1917 | Mosher | 254/133 R |
| 2,779,567 | 1/1957 | Kohler | 254/131 |
| 2,979,017 | 4/1961 | Soper | 254/120 |
| 3,512,755 | 5/1970 | Donakowski | 254/131 |
| 3,779,517 | 12/1973 | Fisher . | |
| 3,809,261 | 5/1974 | Lee | 254/131 |
| 4,433,829 | 2/1984 | Grover et al. | 254/131 |
| 4,533,117 | 8/1985 | Schwang | 254/131 |
| 4,991,893 | 2/1991 | Gordon et al. | 254/131 |
| 5,211,264 | 5/1993 | Beattie et al. . | |
| 5,242,153 | 9/1993 | Stuart | 254/131 |
| 5,339,926 | 8/1994 | McCanse et al. . | |

*Primary Examiner*—Robert C. Watson

[57] ABSTRACT

A combined lift and stand for vehicles includes a pair of spaced side rails connected by upper and lower cross bars. Each side rail has a foot section and an arcuate section, the arcuate sections comprising a pair of cooperating rockers. A connector for attachment to a vehicle such as a golf cart is located on the upper cross bar. The lower cross bar has a lever sleeve in which is slidably disposed an elongated lever arm. The elongated lever arm is used to pivot or rock the combined lift and stand around the rockers so that the vehicle is elevated to a maintenance position. Once in the maintenance position, the elongated lever arm is slid under the vehicle so that the vehicle is stabilized and cannot roll off of the combined lift and stand.

15 Claims, 7 Drawing Sheets

COMBINED LIFT AND STAND FOR VEHICLES

CROSS REFERENCE TO RELATED APPLICATION

This application is a continuation-in-part of application Ser. No. 08/606/289 filed Feb. 23, 1996, now abandoned the disclosure of which is incorporated herein by reference.

FIELD OF INVENTION

The present invention relates to lifts and stands for wheeled vehicles such as golf carts, recreational vehicles, service vehicles, garden mowers and garden tractors, specifically for the purpose of the inspecting, servicing and repairing of such vehicles.

BACKGROUND OF INVENTION

Golf carts are routinely inspected, serviced and repaired by golf course equipment maintenance personnel, usually a mechanic. Service of the brakes, tires and general mechanical operations requires that the cart be elevated and retained about 17 inches above the floor.

The most common method currently used to elevate carts employs a conventional floor jack of ratchet, screw, scissors or hydraulic type. To raise one end of the cart by this method several steps are necessary: (1) place jack under axle of left side, (2) elevate, (3) place a floor stand under the axle, (4) lower and remove jack, (5) place under axle of left side, (6) elevate, (7) place a floor stand under the axle at left side, (8) lower and remove jack. To lower the cart the jack must again be placed under the axle and the cart raised slightly to allow the removal of the floor jacks. This method of raising and lowering one end of the cart takes about eight (8) minutes of the skilled mechanic's time and requires one jack and two floor stands.

Excessive time is spent lifting with floor jacks. A typical golf course in the United States has 75 carts. On average, each cart will be raised five (5) times per year. Therefore, fifty (50) hours per year are spent raising and lowering carts at one course.

It is physically awkward to access the structural member, the axle, to which a floor jack is applied. The axle is located under the cart recessed about 30 centimeters from the front and about 50 centimeters from the rear. To position the jack, the mechanic must be on his hands and knees on the ground and partially under the cart Whether on the ground or a dirty shop floor, positioning floor jacks and stands under the axle is a dirty task.

A mechanic is in physical jeopardy any time he is under a cart which is supported by a conventional floor jack or stand. Because the base of such devices is small in relation to height and load, an elevated cart that is pushed from side to side or from front to back is easily dislodged from a floor jack or stands. Mechanics' hands are frequently abraded or knocked on the floor while pumping the handle of a ratchet or screw jack. Although a minor injury, the frequency of occurrence makes this a design flaw.

Floor jacks are typically comprised of two or more unconnected parts, i.e., the handle and the stand. When these parts get separated, the tool is rendered ineffective. Likewise, when the floor stands are not available for use in conjunction with the jack, the servicing operation is less efficiently done.

Golf cart flat tires occurring on the course are not currently changed at the breakdown site because: (a) floorjacks are not readily portable, (b) to function, floor jacks require a flat, dependable, hard surface, such as a floor. Previously a flat tire occurring on the playing course required the time of two (2) employees. One employee drove a replacement cart to the player. A second employee drove a towing vehicle to the breakdown site and then towed the broken cart back to the maintenance building.

The gears, racks, cogs and threads of ratchet and screw jacks get stripped. This damage is not repairable and thus necessitates a new purchase.

The price of a floor jack and two floor stands is significant.

Chain hoists are not suitable for lifting a golf cart. The cart has no appropriate structure to which to attach a chain. Also a golf cart cannot be dependably balanced from a chain hoist.

Several types of alternative lifts have been proposed: in U.S. Pat. No. 5,339,926 to McCanse and Fulmer (1993), U.S. Pat. No. 3,779,517 to Fisher (1973), and U.S. Pat. No. 5,211,264 to Beattie and Sinden (1991). The lifts and stands cited above suffer from a number of disadvantages:

(a) Significant storage space is required in what are typically cramped golf course maintenance shops.

(b) Cart tires are in cups or on rails and, therefore, elements of the power train, motor, breaks, belts, and batteries cannot be tested under power.

(c) Wheels and tires cannot be removed because the cart is supported by the wheels while elevated by these means. Therefore, tire changing and brake work cannot be done on these lifts.

(d) Alignment of vehicles on support rails is difficult.

(e) They are large and therefore not easily portable.

(f) The price is significant.

Heretofore, there has not been a fast, safe, and economical means of lifting lightweight vehicles such as golf carts.

SUMMARY OF THE INVENTION

The present invention is directed to a combined lift and stand for elevating vehicles to a maintenance position. The combined lift and stand (1) is easily and rapidly operated by one person, (2) is mechanically simple having few moving parts, and (3) provides a surprisingly stable base for the raised vehicle by means of an elongated lever arm which slides through a lever sleeve to assume a position under the lifted vehicle. The combined lift and stand includes a pair of spaced side rails connected by an upper cross bar. Each side rail has a foot section and an arcuate section, the arcuate sections comprising a pair of cooperating rockers. A connector for attachment to a vehicle such as a golf cart is located on an upper cross bar which connects the two side rails. A lower cross bar is connected between the side rails and has the lever sleeve in which the elongated lever arm is slidably disposed. In an extended position, the elongated lever arm is used to pivot or rock the combined lift and stand around the rockers so that the vehicle is elevated to a maintenance position. Once the vehicle is raised to the maintenance position, the elongated lever arm is slid through the lever sleeve to a position under the vehicle so that the vehicle cannot roll backwards or otherwise fall off of the combined lift and stand.

It is the object of the present invention to provide an improved lifting device combined with a stand for lightweight vehicles such as golf carts, recreational vehicles, and service vehicles for the purpose of facilitating service, inspection, and repair.

Several objects and advantages of the present invention are:

(a) to provide a fast (about 5 seconds) means of elevating lightweight vehicles, which in a business situation, increases effectiveness of mechanics' wages;

(b) to provide a relatively small, yet tremendously stable, lift with a three-point (3-point) point stabilizing base, which is almost equal to the length and width of the vehicle elevated, which prevents an elevated cart from tipping from front to back and thus provides a safer lift;

(c) to provide a secure interlocking engagement between the cart's structural frame (the towing hole) and lift which prevents and elevated cart, under normal circumstances, from sliding off the lift, and thus provides a safer lift;

(d) to provide a wide, three (3) point, support engagement between the carts structural frame (the towing hole) and lift which prevents an elevated cart, under normal circumstances, from sliding off the lift, and thus provides a safer lift;

(e) to reduce the chance of bodily injury by creating a safer operating position for the person while he is positioning the jack and while he is elevating the vehicle;

(f) to eliminate hand injuries received while pumping a ratchet or screw-type jack handle;

(g) to simplify the process of lifting and retaining the vehicle by reducing the seven (7) steps previously listed to elevate and retain a golf cart with conventional floor jacks to three (3) quicker, easier steps;

(h) to provide a device which comprises in one tool both a lift and a stand;

(i) to provide a lift which eliminates the mechanic's need to crawl under the cart while engaging the lift to the cart and providing an engagement point, the tow package hole, which is easily visible and accessible from a standing position;

(j) to provide a lift in which the engagement point with the cart is automatically centered, side to side, and thus elevating the cart from a balanced position;

(k) to provide a lift which reduces the amount of energy required of the servicepersonto operate it;

(l) to provide a lift in which the operator remains clean while using it;

(m) to provide a lift without long handles or other obstruction which hinder access to an elevated cart while servicing work is done;

(n) to provide a lift which allows work on the power-train elements while the motor is running;

(o) to provide a lift with dependable repeatability so that the cart is automatically elevated to the same desired height every time;

(p) to provide a lift which is portable;

(q) to provide a lift which can be used at the site of a flat tire even when it occurs on the grass on the golf course;

(r) to provide a simpler, more dependable lift comprised of few parts;

(s) to provide a lift which is always together because the component parts are not readily detached;

(t) to provide a lift which is relatively small and easily stored;

(u) to provide a lift which is easily shipped; and, (v) to provide a lift which is economically priced.

In accordance with a preferred embodiment of the invention, a combined lift and stand for raising a vehicle off of the ground to a maintenance position includes a first substantially J-shaped side rail, a second substantially J-shaped side rail. An upper cross bar connects the first side rail to the second side rail so that the first and second side rails form two spaced rockers. A connector is disposed on the upper cross bar for connecting the combined lift and stand to the vehicle. A lower cross bar is connected between the first side rail and the second side rail, the lower cross bar having a middle portion on which is disposed a perpendicular lever sleeve. An elongated lever arm is slidably disposed within the lever sleeve, and it has an extended position for achieving leverage to raise the vehicle to the maintenance position using the two rockers. Once the vehicle is raised, the lever sleeve is substantially horizontal, and the elongated lever arm is slid toward and under the vehicle through the horizontal lever sleeve.

In accordance with an important aspect of the invention, the connector further includes the upper cross bar being substantially circular and having a middle portion. A pivot assembly is rotatably connected to the middle portion of the upper cross bar.

In accordance with an important feature of the invention, the pivot assembly further includes a rotatable sleeve surrounding the upper cross bar. An alignment pin is connected to the rotatable sleeve, the alignment pin being oriented substantially perpendicular to the upper cross bar.

In accordance with another important aspect of the invention, a means for continuously keeping the alignment pin vertically oriented is provided. In a preferred embodiment, the means comprises a counter weight connected to the rotatable sleeve, the counter weight disposed on an opposite side of the rotatable sleeve from the alignment pin.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The present invention will be more fully understood by reference to the accompanying drawings in which.

DETAILED DESCRIPTION OF THE PREFERRED EMBODIMENTS

Figure 1:
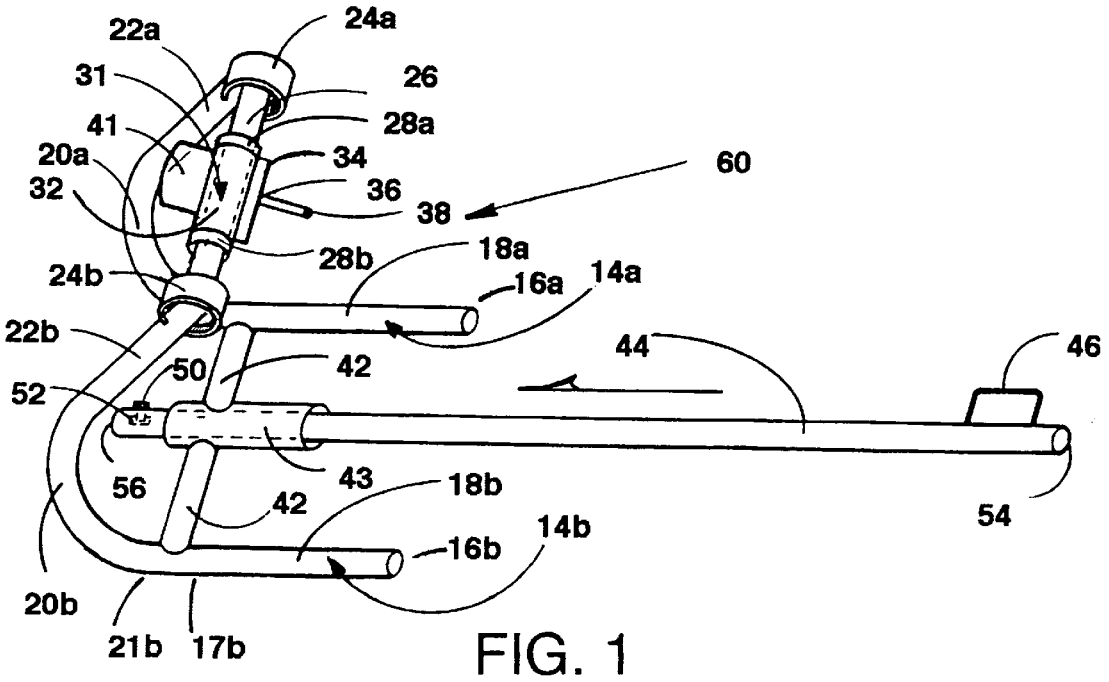
FIG. 1 is a perspective view of a combined lift and stand for light weight vehicles in accordance with the present invention.
Figure 2:
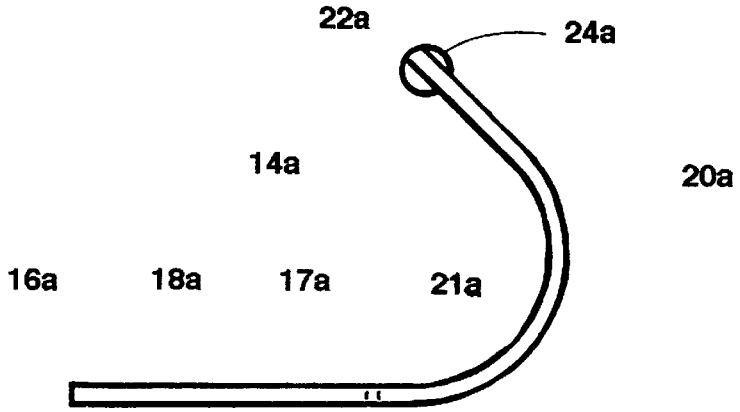
FIG. 2 is a side elevation view of a side rail.

Referring initially to FIG. 1, there is illustrated a perspective view of a combined lift and stand for vehicles, generally designated as 60. FIG. 2 is a side elevation view of a side rail 14*a*.

Lift 60 has a first side rail 14*a* including a first foot section 18*a* and a first arcuate section 20*a*. The first foot section 18*a* and first arcuate section 20*a* each have a first end 17*a* and 21*a* and an opposite second end 16*a* and 22*a*. The first end 17*a* of first foot section 18*a* is connected to the first end 21*a* of first arcuate section 20*a*. A second side rail 14*b* includes a second foot section 18*b* and a second arcuate section 20*b*. The second foot section 18*b* and second arcuate section 20*b* each have a first end 17*b* and 21*b* and an opposite second end 16*b* and 22*b*. The first end 17*b* of second foot section 18*b* is connected to the first end 21*b* of second arcuate section 20*b*. The first side rail 14*a* is substantially J-shaped and defines a first plane. The second side rail 14*b* is substantially J-shaped and defines a second plane. The first plane is substantially parallel to the second plane. First and second foot sections 18*a* and 18*b* are substantially straight and laying substantially flat upon the ground when the vehicle 500 is in the maintenance position. It is noted, that as used herein, the term ground applies to dirt, grass, a paved surface, or a floor. First and second side rails 14*a* and 14*b* are of uniform cross section strong metal tubing which can adequately support 500 pounds. The arc is accomplished by means of a hydraulic or mechanical pipe bender. In the preferred embodiment, first and second side rails 14*a* and 14*b* are 103.5 centimeters long. First and second foot sections are 46 centimeters long. First and second arcuate sections 20*a* and 20*b* are each 57.5 centimeters long and radius for 120 degrees.

Figure 3:
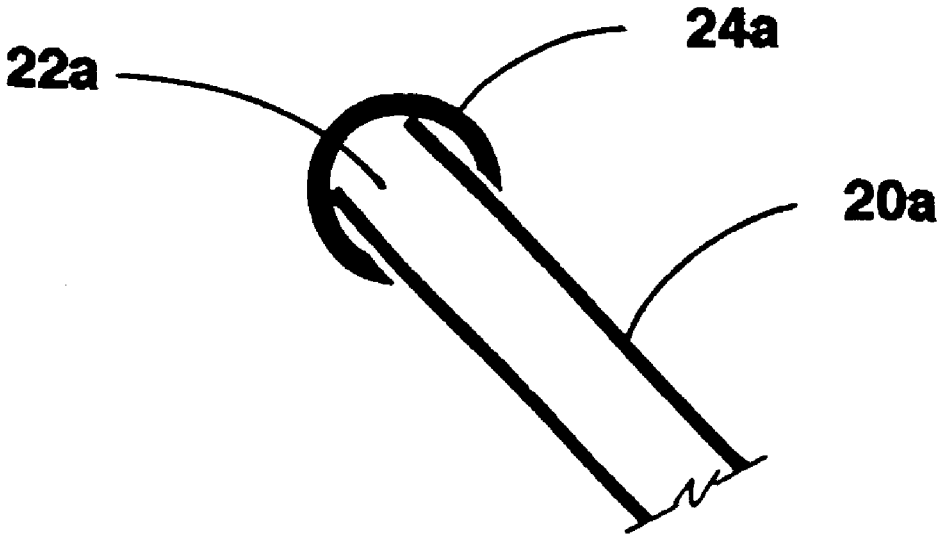
FIG. 3 is an enlarged side elevation view illustrating the attachment of a support collar to the side rail.
Figure 4:
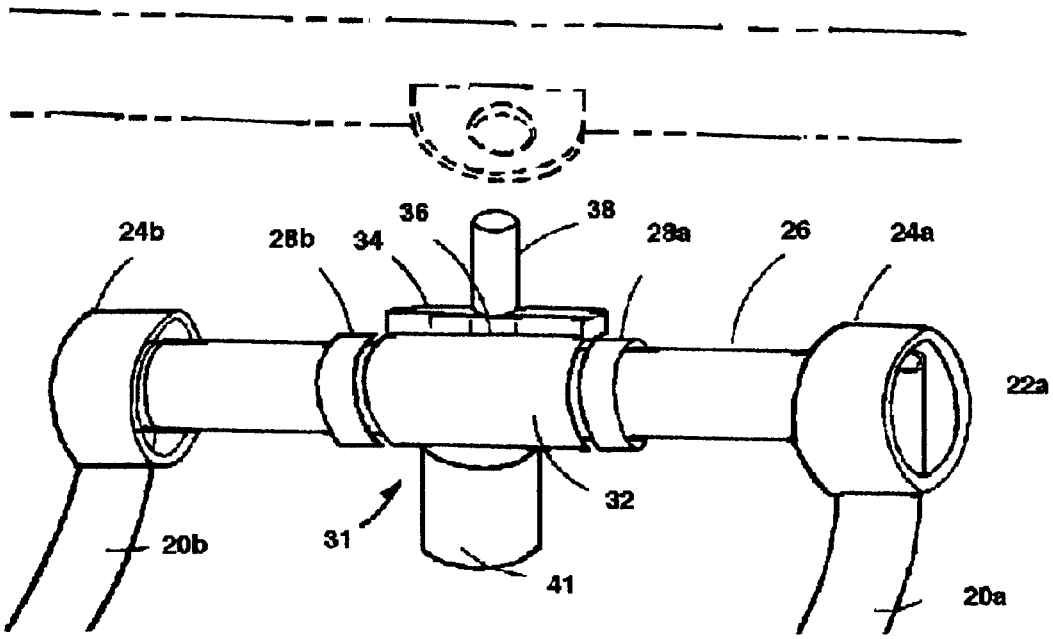
FIG. 4 is an enlarged perspective view of an upper cross bar with a connector.

FIG. 3 is an enlarged side elevation view illustrating the attachment of a support collar 24*a* to side rail 20*a*. The right and left support collars 24*a* and 24*b* are sections of strong steel tubing. Their diameter is slightly larger than that of side rails 14*a* and 14*b*. The length of support collars 24*a* and 24*b* is about the same as their diameter. Removed from the circumference of support collars 24 and 24*b* is a section slightly larger than the diameter of the side rails 14*a* and 14*b*. Referring also to FIG. 4, right support collar 24*a* fits over the connection point of upper cross bar 26 to second end 22*a* of first arcuate section 20*a*. Right support collar 24*a* is positioned so that its' right end is flush with the outside of first arcuate section 20*a*. The inside wall of right support collar 24*a* contacts to the second end 22*a* of first arcuate section 20*a*. The points of contact are welded together. Left support collar 24*b* is positioned and attached to second arcuate section 20*b* in the same manner. In the preferred embodiment, support collars 24*a* and 24*b* are 4 centimeters long and of 53 centimeters inside diameter, schedule 40 galvanized steel tube of 3 millimeters wall thickness.

FIG. 4 is an enlarged perspective view of upper cross bar 26 with a connector. Upper cross bar 26 connects first arcuate section 20*a* to second arcuate section 20*b*, so that first side rail 14*a* and second side rail 14*b* form two spaced rockers, wherein a rocking action can take place around first and second arcuate sections 20*a* and 20*b*. Upper cross bar 26 is connected near second end 22*a* of first arcuate section 20*a* and near the second end 22*b* of second arcuate section 20*b*. Upper cross bar 26 is substantially perpendicular to the first and second planes of first and second side rails 14*a* and 14*b*. In the preferred embodiment, upper cross bar 26 is 44 centimeters long and is made of schedule 40, steel pipe of 3 millimeters wall thickness and with internal welded seams. Its' ends are welded at right angles to the inside of first and second arcuate sections 20*a* and 20*b*. The top of upper cross bar 26 is flush with the second ends 22*a* and 22*b* of first and second arcuate sections 20*a* and 20*b*. The width of the present invention is the outside dimension of side rails 14*a* and 14*b* with upper cross bar 26 between them. This width is slightly less than the inside dimension of the rear shackles of a golf cart.

Figure 7:
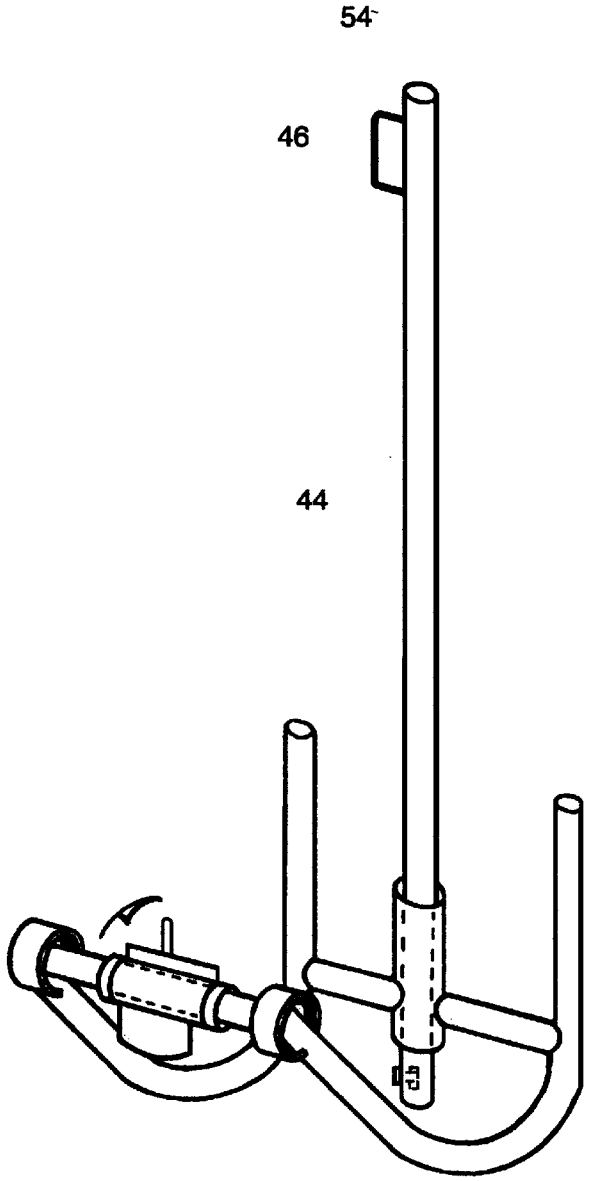
FIG. 7 is a perspective view illustrating a bifurcated member and elongated foot section.

Upper cross bar 26 is substantially circular and has a middle portion 33. A connector is disposed on upper cross bar as a means for connecting combined lift and stand 60 to the vehicle 500. As shown in FIG. 4 and FIG. 7, the connector includes a pivot assembly 31, which further includes a rotatable sleeve 32, an alignment pin 38 or bifurcated member 39, a means for continuously keeping alignment pin 38 or bifurcated member 39 vertically oriented 40, a counter weight 41, a pivot plate 34, and a pivot hole 36. Pivot assembly 31 is rotatably connected to the middle portion of upper cross bar 26. Rotatable sleeve 32, surrounds upper cross bar 26. As shown in FIG. 4, right and left retaining collars 28*a* and 28*b* are adjacent to both ends of rotatable sleeve 32 as a means of retaining pivot assembly 31 in a fixed lateral position at the midpoint 33 on the upper cross bar 26. In the preferred embodiment, retaining collars 28*a* and 28*b* are 1.5 centimeters long and rotatable sleeve is 7.5 centimeters long. Retaining collars 28*a* and 28*b* and rotatable sleeve 32 are made of 3.2 centimeters inside diameter, schedule 40, steel pipe of 3 millimeters wall thickness with internal welded seam. Retaining collars 28*a* and 28*b* are solid welded to upper cross bar 26.

A pivot plate 34 is parallel to and affixed at the top of (at zero degrees), rotatable sleeve 32. It is of sturdy metal, the length of which corresponds respectively to the length and outside diameter of the pivot sleeve 32. Pivot plate hole 36 is centered on the length and the width of pivot plate 34. Pivot hole 36 is of slightly larger diameter than the outside diameter of an alignment pin 38. In the preferred embodiment, pivot plate 34 is cold rolled steel bar, 7.5 centimeters long×3.75 centimeters wide×1.5 centimeters thick. After alignment pin 38 is welded to pivot plate 36, pivot plate 34 is solid welded to rotatable sleeve 32. Pivot hole 36 is 1.55 centimeters diameter.

As shown in FIG. 4, alignment pin 38 is connected to rotatable sleeve 32 and is oriented substantially perpendicular to upper cross bar 26. Alignment pin 38 is centered on length and width of, and perpendicular to, pivot plate 34. Alignment pin 38 is made of strong metal rod, the top tip of which is slightly rounded. Alignment pin 38 is of sufficient length to provide a secure engagement between vehicle 500 tow hole and lift 60. Alignment pin 38 is pressed into pivot plate hole 36 until its bottom end is almost flush with the bottom surface of pivot plate 34. Alignment pin 38 is securely affixed to pivot plate 34 in a manner so that both the top and bottom surfaces of pivot plate 34 remain flat. In the preferred embodiment, alignment pin 38 is of 1.5 centimeters diameter cold-rolled steel rod and is 4.5 centimeters long. A recess, approximately 2 millimeters deep between the bottom of alignment pin 38 and bottom of pivot plate 34, is provided for a welded joining.

Pivot assembly 31 includes a means for continuously keeping alignment pin 38 vertically oriented. As shown in FIG. 4, a means for continuously keeping alignment pin 38 vertically oriented is a counter weight 41. It is connected to rotatable sleeve 32 and disposed on an opposite side of rotatable sleeve 32 from alignment pin 38. Counter weight is of slightly greater weight than the combined weight of pivot plate 34 and alignment pin 38. In the preferred embodiment, counter weight 41 is 70 grams. It is made of 4.4 centimeters diameter steel bar, 6.35 centimeters long. It is solid welded to rotatable sleeve 32.

As shown in FIG. 7, in an alternate embodiment, the engaging element can be a bifurcated member 39 having two prongs connected to rotatable sleeve 32. The two prongs of bifurcated member 39 are oriented substantially perpendicular to and away from upper cross bar 26. The prongs are of sufficient length and strength to provide a secure engagement between vehicle 500 structural member, such as an axial, and lift 60. When bifurcated member 39 is used, pivot assembly 31 includes a means for continuously keeping two prongs vertically oriented. A means for continuously keeping the two prongs vertically oriented is a counter weight connected to rotatable sleeve 32. Counter weight 41 is disposed on an opposite side of rotatable sleeve 32 from the two prongs. Counter weight 41 is of slightly greater weight than the combined weight of pivot plate 36 and bifurcated member 39.

Specifically, side rails 16*a* and 16*b*, upper cross bar 26, and a lower cross bar 42 are all made of the same material. In this embodiment, they are made of 2.5 centimeter inside diameter, schedule 40 steel tube of 3 millimeter wall thickness, and with an internal welded seam.

Figure 5:
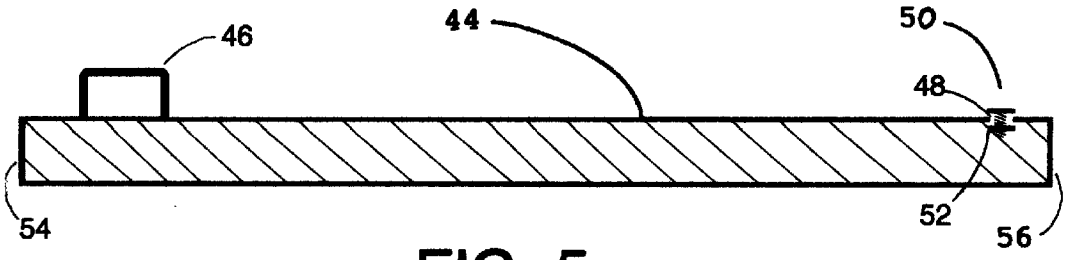
FIG. 5 is a cross sectional view of an elongated lever arm.
Figure 6:
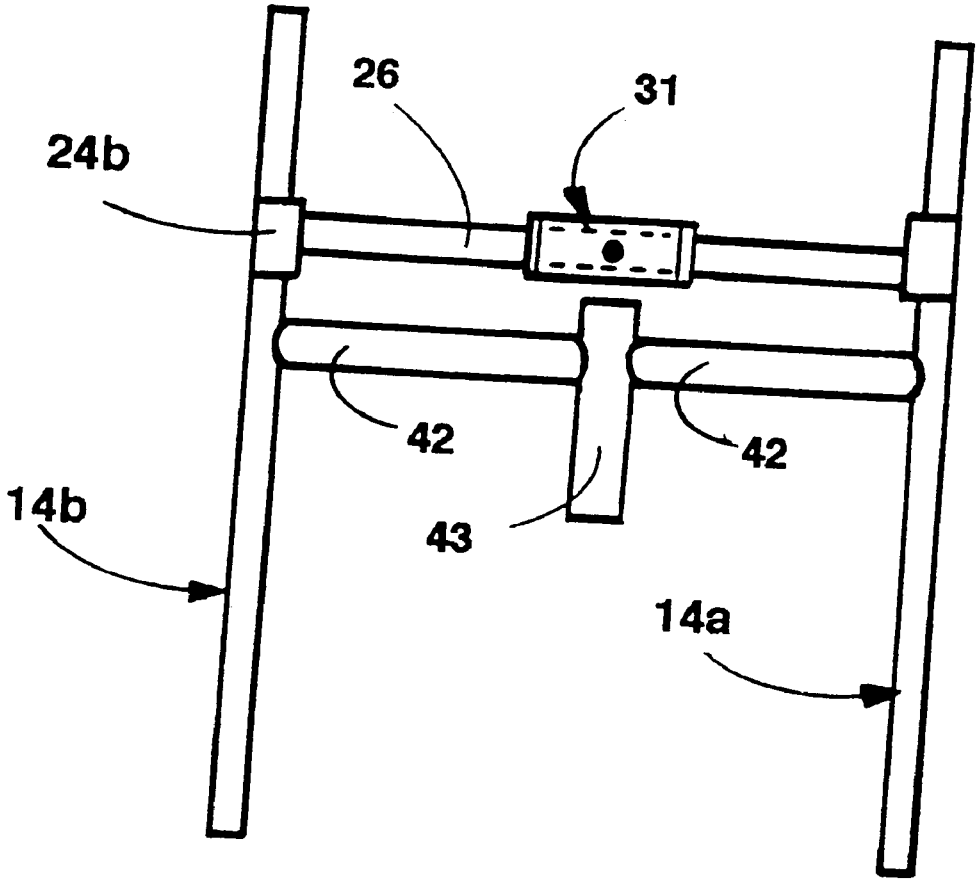
FIG. 6 is a top plan view of the combined lift and stand without an elongated lever arm.

FIG. 6 is a top plan view of the combined lift and stand without a lever arm, and FIG. 5 is a cross sectional view of an elongated lever arm 44. A lower cross bar 42 connects first foot section 18*a* to second foot section 18*b*. Lower cross bar 42 has a middle portion and is substantially parallel to upper cross bar 26. Lower cross bar 42 connects with first and second side rails 14*a* and 14*b* at approximately the first ends 17*a* and 17*b* of side rails 14*a* and 14*b*. All lower cross bar 42 ends have a fish-mouth shaped cut. This concave cut facilitates a strong weld between the end of a tube with the diameter of a tube. In the preferred embodiment, the right and left sides of lower cross bar 42 are each 20 centimeters long.

A lever sleeve 43 is disposed in the middle portion of lower cross bar 42. Lever sleeve 43 is substantially perpendicular to lower cross bar 42. Lever sleeve is substantially coplanar with first and second straight foot sections 18*a* and 18*b*. Lever sleeve 43 is of uniform cross section strong metal tubing, the inside of which is smooth and clear to allow the unobstructed sliding of an elongated lever arm 44 through it. In the preferred embodiment, lever sleeve 43 is 15 centimeters long and is made of 3.5 centimeters inside diameter, schedule 40 steel tube of 3 millimeters wall thickness and with internal welded seam.

As shown in FIG. 1 an elongated lever arm 44 is connected to first and second side rails 14*a* and 14*b* via lever sleeve 43 and lower crossbar 42. Lever 44 is slidably disposed within lever sleeve 43. Lever 44 has an extended position for achieving leverage to raise vehicle 500 to the maintenance position. Once vehicle 500 is raised, lever 44 is slidable toward and under vehicle 500 as a stabilizing means, so that vehicle 500 will not fall off of the combined lift and stand 60. Lever 44 arm is laying substantially flat upon the ground when vehicle 500 is in the maintenance position, and lever sleeve 43 is in a substantially horizontal position. Lever 44 is made of uniform cross section strong metal tubing which can lift 500 pounds. In the preferred embodiment, lever 44 is made of a 1.5 meters length of 2.5 centimeters inside diameter, schedule 40 galvanized steel tube of 3 millimeter wall thickness and with an internal welded seam.

In an alternate embodiment, as shown in FIG. 7, elongated lever arm is comprised of elongated first and second foot sections 19*a* and 19*b* so as to provide sufficient leverage to raise vehicle 500.

As shown in FIG. 5, lever 44 has a grip handle 46 disposed at one end. It is a U-shaped steel rod of comfortable hand holding dimensions. Grip 46 is affixed to the top side, at zero degrees, lengthwise on lever 44. In this embodiment, grip 46 is 5 centimeters high×13 centimeters long. It is made of 9.5 millimeters diameter galvanized steel rod. Grip 46 is welded to lever 44 at 2.5 centimeters from the grip end 54 of lever 44. The welds and cut ends on lever 44 are cold galvanized.

Lever 44 is captively prevented from exiting lever sleeve 43. As shown in FIG. 5, near a stop end of lever 56, is a threaded hole 48 through one wall of lever 44. Threaded hole 48 is on the top of lever 44, in a straight line with grip handle. In alignment with threaded hole 48, a nut 52 is secured to the inside wall of lever 44. A lever stop bolt 50 is inserted through hole 48 and is screwed into nut 52. In the preferred embodiment, bolt 50 is a 8 millimeter×1.00 (thread)×13 centimeters long hexagon head machine bolt. Threaded hole is 9 millimeters in diameter and is 2.5 centimeters form stop end of lever 56. Nut 52 is 8×1.00 and is tack welded to inside diameter of lever 44.

The present invention is utilized in a method for raising vehicle 500 off of the ground to maintenance position.

The operation of the combined lift and stand 60 to elevate and retain lightweight vehicle 500, such as a golf cart, for inspection, maintenance, and repair is unique. Lift 60 works well to elevate either the front or rear end of a four-wheeled lightweight vehicle 500. For the purpose of this example, the procedure for elevating the front end of golf cart 500 will be discussed.

Figure 8:
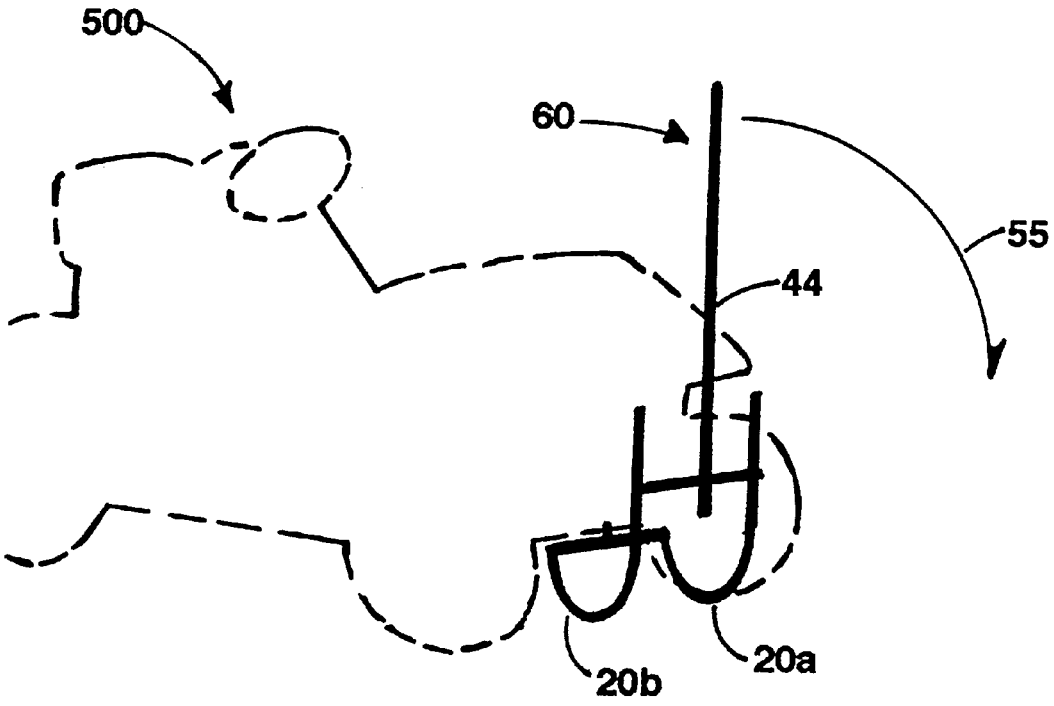
FIG. 8 is a reduced perspective view of the combined lift and stand in the aligning position phase prior to lifting the lightweight vehicle; and, FIG. 9 is a reduced perspective view illustrating one embodiment of the combined lift and stand invention retaining an elevated golf cart.

A connector disposed on upper cross bar 26 is for connecting combined lift and stand 60 to vehicle 500. As shown in FIGS. 4 and 8, a service person orients combined lift and stand 60 so that elongated lever arm 44 is substantially vertical and in an extended position and so that first and second arcuate sections 20*a* and 20*b* are on the ground. Lift 60 is positioned so that alignment pin 38 is directly under golf cart 500 tow hole. Alignment pin 3 8 is always in a vertical, ready for engagement position. This is because counter weight 41 is opposite alignment pin 38 and is of greater weight than the combined weight of alignment pin 38 and pivot plate 34, and because rotatable sleeve 32 freely rotates around upper cross bar 26.

The tow hole, as in FIG. 4, is part of a towing package provided on most new golf carts 500. The tow package is of structural integrity and is capable of being the cart engagement member to which lift 60 is applied. Being at the extreme front and rear of cart 500, the tow holes are an easily accessible engagement point.

Connecting connector to the vehicle is done by slightly raising lift 60 so that alignment pin 38 is inserted through cart 500 tow hole. Immediately after the engagement of lift 60 with cart 500, lever 44 is rotated downward in direction 55, away from cart 500, so that lift 60 pivots or rocks around first and second arcuate sections 20*a* and 20*b* thereby raising the vehicle off of the ground to the maintenance position. During the lifting phase, grip end 54 will have made an imaginary arc form the top vertical position to the horizontal position on the floor. At the completion of the lifting phase, the entire length of elongated lever arm 44 is laying substantially flat upon the ground.

While pulling lever 44 toward the ground, two hands are used, one on the grip handle 46 and the other hand near the first hand on lever 44. As grip end of lever 54 approaches the ground, the weight of the cart 500 begins to force lever 44 downward. Because cart 500 weight is helping at is point, the service person can hold solely by grip 46, keeping hands in a safe position.

As cart 500 is lifted, upper cross bar 26 is elevated. During the elevating process, cart's 500 rear weight is supported on several points of lift 60. Cart's 500 front weight is supported on pivot plate 34 at cart 500 tow hole bracket. Cart's 500 weight is also supported on right and left support collars 24*a* and 24*b* where they contact with cart 500 tow structural cross members. As the vehicle is elevated, the side contact points (structural cross member) of the cart slide around the outside diameter of support collars 24*a* and 24*b*. Concurrent with the above, pivot assembly 31 rotates around upper cross bar 26. As pivot assembly rotates, the connector, alignment pin 38, maintains a vertical position. During elevation, cart's 500 front end is securely held to lift 60 by alignment pin 38. Concurrently, cart 500 rolls forward, toward lift 60, about 61 centimeters on its' back wheels as the front of cart 500 is elevated. During use of lift 60, golf cart 500 brake must not be engaged. As upper cross bar 26 raises, the center of gravity of the cart at alignment pin 38 moves back until it is about over lower cross bar 42.

During the lifting operation, the engagement of alignment pin 38 with cart's 500 tow hole, combines with the gravitational downward force of the cart on lift 60 to provide a secure attachment.

Upon completion of the elevation operation, golf cart's 500 elevation height is always the same. The elevation is the height which is determined to best facilitate servicing operation. Cart's 500 elevation height is consistent with the combined height of side rails 14*a* and 14*b* and support collars 24*a* and 24*b*. Height is most easily adjusted by changing the length of the straight portions of arcuate sections 20*a* and 20*b*. In the preferred embodiment the height is 42.5 centimeters.

Figure 9:
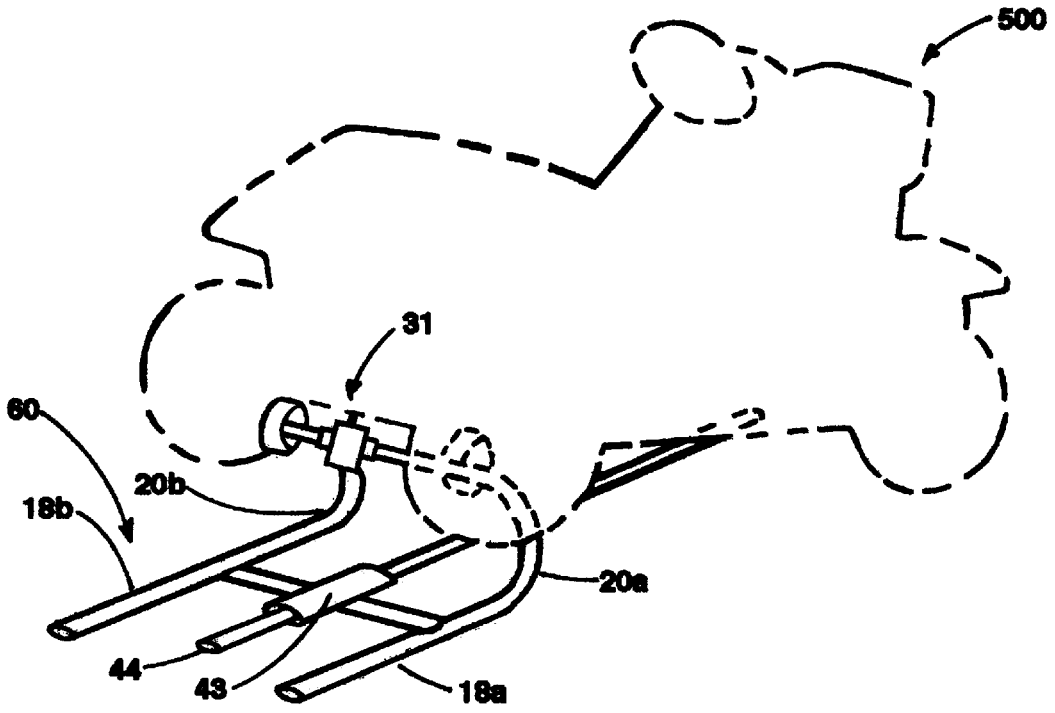

As shown in FIG. 9, elongated lever arm 44 is slid toward and under the vehicle once the vehicle is raised to the maintenance position. Holding grip handle 46, lever 44 is slid forward, through lever sleeve 43, until grip handle 46 reaches lever sleeve 43. Lever 44 is easily slid when lift 60 is functioning as a stand because, at this time, there is insignificant weight or resistance on it.

As shown in FIG. 7, bolt 50 functions as a stop to indicate that lever 44 is at its complete extension, the correct lifting position. Bolt 50 is a retaining device prohibiting lever 44 from exiting lever sleeve 43 at stop end of lever 56. Because bolt 50 unites lift 60 into one unit, all parts necessary for its operation are always present. As a single unit, lift 60 is conveniently carried by lever 44. Bolt 50 also facilitates shipping. By removing bolt 50, lever 44 can be slid out of lever sleeve 43. And thus lift 60, in two parts, complies with United Parcel Service size restrictions.

Grip handle 46 provides several functions: (1) as a stop to indicate lever 44 is at correct stabilizing position, (2) as a retaining device which prohibits lever 44 from exiting lever sleeve 43 at grip end 54, (3) to facilitate picking up lever 44 from the floor.

As shown in FIG. 9, the golf cart 500 is elevated and securely held in maintenance position by combined lift and stand 60. The present invention is serving as a stand at this period of the operation. The elevated cart is securely held at multiple points:

(1) alignment pin 38 prevents cart 500 from slipping off lift 60.

(2) right and left support collars 24*a* and 24*b* prevent cart 500 from tipping from side to side.

(3) lever 44 contact with the ground 500 under cart prevents lift 60 from tipping from front to back.

(4) first and second foot sections 18*a* and 18*b* provide a wide support base.

Painting lift 60 a contrasting color to that of the vehicle facilitates alignment of lift 60 with the vehicle. In the preferred embodiment, lift 60 is painted white by the powder-coating method. This color is a high contrast to the dark bumper area of a golf cart.

To reduce unsightly scratches on lever 44, caused by sliding through lever sleeve 43, lever 44 is made of unpainted mar resistant material. In the preferred embodiment, lever 44 is galvanized steel.

Lift 60 is easily portable. It is conveniently transported in the golf club bag rack of a golf cart 500. It is positioned vertically and strapped in the same manner as a golf club bag. The portability and wide support base of lift 60 facilitates servicing of a golf cart 500 on the grass at the site of a flat tire. One employee drives a replacement golf cart 500 carrying lift 60 and a spare tire to the breakdown site. Lift 60 and the spare tire are off loaded. The player takes the replacement cart 500 and continues his/her game. The employee does the quick repair on site, loads lift 60 onto the cart, and drives away. Not needing to tow a disabled cart 500 to the maintenance building, the employee can then go directly to his next assignment.

Ramification: The center of gravity could be changed by altering the degrees of a circle of first and second arcuate sections 20*a* and 20*b* arch. Lift 60 stability is increased by continuing the arc of arcuate section 20*a* and 20*b* beyond the 120 degrees of the preferred embodiment. This embodiment is suitable for use on vehicles which have a higher clearance between the ground and the vehicle than is typical of golf carts.

While the present invention is described with reference to a stand for and lifting of golf carts, such reference is for purposes of clarity only. Although particularly adapted for such use, other uses are envisioned and therefore no intent to limit the scope of the invention is expressed.

The preferred embodiments of the invention described herein are exemplary and numerous modifications, dimensional variations, and rearrangements can be readily envisioned to achieve and equivalent result, all of which are intended to be embraced within the scope of the appended claims.

I claim:

1. A combined lift and stand for raising a vehicle off of the ground to a maintenance position, comprising:

a first side rail including a first foot section and a first arcuate section, said first foot section having a first end and an opposite second end, said first arcuate section having a first end and an opposite second end, said first end of said first foot section connected to said first end of said first arcuate section;

a second side rail including a second foot section and a second arcuate section, said second foot section having a first end and an opposite second end, said second arcuate section having a first end and an opposite second end, said first end of said second foot section connected to said first end of said second arcuate section;

an upper cross bar connecting said first arcuate section and said second arcuate section so that said first and second side rails form two spaced rockers;

a connector disposed on said upper cross bar for connecting said combined lift and stand to the vehicle;

an elongated lever arm connected to said first and second side rails; and, said elongated lever arm laying substantially flat upon the ground when the vehicle is in the maintenance position.

2. A combined lift and stand according to claim 1, further including:

said first side rail substantially J-shaped and defining a first plane;

said second side rail substantially J-shaped and defining a second plane; and, said first and second foot sections substantially straight and laying substantially flat upon the ground when the vehicle is in the maintenance position.

3. A combined lift and stand according to claim 2, further including:

said first plane substantially parallel to said second plane; and, said upper cross bar substantially perpendicular to said first and second planes.

4. A combined lift and stand according to claim 1, said connector further including:

said upper cross bar being substantially circular and having a middle portion; and, a pivot assembly rotatably connected to said middle portion of said upper cross bar.

5. A combined lift and stand according to claim 4, said pivot assemble further including:

a rotatable sleeve surrounding said upper cross bar, an alignment pin connected to said rotatable sleeve, said alignment pin oriented substantially perpendicular to said upper cross bar; and, means for continuously keeping said alignment pin vertically oriented.

6. A combined lift and stand according to claim 5, said means for continuously keeping said alignment pin vertically oriented comprising a counter weight connected to said rotatable sleeve, said counter weight disposed on an opposite side of said rotatable sleeve from said alignment pin.

7. A combined lift and stand according to claim 4, said pivot assembly further including:

a rotatable sleeve surrounding said upper cross bar;

a bifurcated member having two prongs connected to said rotatable sleeve, said two prongs oriented substantially perpendicular to and away from said upper cross bar; and, means for continuously keeping said two prongs vertically oriented.

8. A combined lift and stand according to claim 7, said means for continuously keeping said two prongs vertically oriented comprising a counter weight connected to said sleeve, said counter weight disposed on an opposite side of said rotatable sleeve from said two prongs.

9. A combined lift and stand according to claim 1, said elongated lever arm comprising said first and second foot sections being elongated so as to provide sufficient leverage to raise the vehicle.

10. A combined lift and stand according to claim 1, further including:

a lower cross bar connecting said first foot section to said second foot section, said lower cross bar having a middle portion, said lower cross bar substantially parallel to said upper cross bar;

a lever sleeve disposed in said middle portion of said lower cross bar, said lever sleeve substantially perpendicular to said lower cross bar;

said elongated lever arm slidably disposed within said lever sleeve; and, said elongated lever arm having an extended position for achieving leverage to raise the vehicle to the maintenance position, and once the vehicle is raised, said elongated lever slidable toward and under the vehicle.

11. A combined lift and stand according to claim 10, further including:

said first and second foot section being substantially straight; and, said lever sleeve substantially coplanar with said first and second straight foot sections.

12. A combined lift and stand according to claim 10, said elongated lever arm captively prevented from exiting said lever sleeve.

13. A combined lift and stand according to claim 10, said elongated lever arm having a grip handle disposed at one end.

14. A combined lift and stand according to claim 1, further including:

said first side rail substantially J-shaped and defining a first plane;

said second side rail substantially J-shaped and defining a second plane;

said first and second foot sections substantially straight and laying substantially flat upon the ground when the vehicle is in the maintenance position;

said first plane substantially parallel to said second plane;

said upper cross bar substantially perpendicular to said first and second planes;

said connector further including said upper cross bar being substantially circular and having a middle portion, a rotatable sleeve surrounding said middle portion of said upper cross bar, and alignment pin connected to said rotatable sleeve, said alignment pin oriented substantially perpendicular to said upper cross bar, a counter weight connected to said sleeve, said counter weight disposed on an opposite side of said rotatable sleeve from said alignment pin;

a lower cross bar connected between said first foot section and said second foot section, said lower cross bar having a middle portion, said lower cross bar substantially parallel to said upper cross bar;

a lever sleeve disposed in said middle portion of said lower cross bar, said lever sleeve substantially perpendicular to said lower cross bar;

said elongated lever arm slidably disposed within said lever sleeve;

said elongated lever arm having an extended position for achieving leverage to raise the vehicle to the maintenance position, and once the vehicle is raised, said elongated lever arm slidable toward and under the vehicle; and, said lever sleeve substantially coplanar with said first and second straight foot sections.

15. A combined lift and stand for raising a vehicle off of the ground to a maintenance position, comprising:

a first side rail having a first arcuate section;

a second side rail having a second arcuate section;

an upper cross bar connecting said first side rail to said second side rail so that said first and second side rails form two spaced rockers;

a connector disposed on said upper cross bar for connecting said combined lift and stand to the vehicle;

a lower cross bar connected between said first side rail and said second side rail, said lower cross bar having a middle portion;

a lever sleeve disposed in said middle portion of said lower cross bar, said lever sleeve substantially perpendicular to said lower cross bar;

an elongated lever arm slidably disposed within said lever sleeve; and, said elongated lever arm having an extended position for achieving leverage to raise the vehicle to the maintenance position using said two rockers, and once the vehicle is raised, said lever sleeve being substantially horizontal, and said elongated lever arm slidable toward and under the vehicle through said horizontal lever sleeve.

* * * * *